US007857402B2

(12) United States Patent
Anikhindi et al.

(10) Patent No.: US 7,857,402 B2
(45) Date of Patent: Dec. 28, 2010

(54) DOOR ASSEMBLY FOR AN APPLIANCE

(75) Inventors: Sanjay Manohar Anikhindi, Karnataka (IN); Paul E. McCrorey, Mt. Washington, KY (US)

(73) Assignee: General Electric Company, Schenectady, NY (US)

( * ) Notice: Subject to any disclaimer, the term of this patent is extended or adjusted under 35 U.S.C. 154(b) by 606 days.

(21) Appl. No.: 11/841,174

(22) Filed: Aug. 20, 2007

(65) Prior Publication Data

US 2007/0284057 A1 Dec. 13, 2007

Related U.S. Application Data

(63) Continuation-in-part of application No. 11/412,248, filed on Apr. 27, 2006.

(51) Int. Cl.
*A47B 95/02* (2006.01)

(52) U.S. Cl. ..... 312/319.4; 49/216

(58) Field of Classification Search ... 312/319.1–319.4, 312/324, 283, 285–287, 139.2; 49/197, 201–204, 49/209, 254–255, 257, 259, 208–212, 221, 49/216

See application file for complete search history.

(56) References Cited

U.S. PATENT DOCUMENTS 2,445,131 A * 7/1948 Avagim ..... 49/212
2,621,097 A * 12/1952 Steinberg ..... 312/139.2
4,063,388 A 12/1977 Little
4,107,879 A 8/1978 Steinman
4,226,049 A 10/1980 Maust
4,337,596 A * 7/1982 Kern et al. ..... 49/210
4,480,408 A 11/1984 Deuman, Sr. et al.
4,702,514 A * 10/1987 Perry ..... 49/209
4,756,123 A 7/1988 Roche et al.
4,884,556 A * 12/1989 Alden et al. ..... 49/209
4,964,228 A * 10/1990 Coffman ..... 49/208
5,186,230 A 2/1993 Ostrander
5,261,720 A * 11/1993 Lomax et al. ..... 49/209
5,347,757 A * 9/1994 Losito ..... 49/211
5,566,508 A * 10/1996 Houston ..... 49/445
6,152,547 A 11/2000 Wang
6,164,014 A * 12/2000 McDowell et al. ..... 49/200

(Continued)

FOREIGN PATENT DOCUMENTS

DE 3101000 * 12/1984

(Continued)

*Primary Examiner*—Hanh V Tran
(74) *Attorney, Agent, or Firm*—Global Patent Operation; Douglas D. Zhang

(57) ABSTRACT

An appliance including a chassis having a top, a bottom, a left and right side opposite one another other and connecting the top and the bottom, and a back opposite an opening. The chassis defines a cavity with an opening for accessing the cavity. A door assembly joined to the chassis includes a door for closing access to the opening and a first and second door lift sub-assemblies. The door lift sub-assemblies are configured to move with the door in a first direction and a second direction different than the first direction. At least one stabilizing device operatively connects the first and second door lift sub-assemblies to synchronize movement of the first and second door lift sub-assemblies in the first direction.

12 Claims, 14 Drawing Sheets

U.S. PATENT DOCUMENTS

| | | | | |
|---|---|---|---|---|
| 6,195,939 | B1 | 3/2001 | Sowers | |
| 6,226,924 | B1 | 5/2001 | Kuzub | |
| 6,561,256 | B2 * | 5/2003 | Mullet | 49/200 |
| 6,600,397 | B2 | 7/2003 | Bassi | |
| 6,691,463 | B1 | 2/2004 | Richmond | |
| 6,766,596 | B1 | 7/2004 | Bienick et al. | |
| 7,150,071 | B2 | 12/2006 | Collene et al. | |
| 7,192,104 | B2 | 3/2007 | Taranitk | |
| 7,234,457 | B2 | 6/2007 | Bartmann et al. | |
| 2004/0093801 | A1 * | 5/2004 | Robert et al. | 49/360 |
| 2005/0023843 | A1 * | 2/2005 | Bartmann et al. | 292/303 |
| 2005/0044799 | A1 | 3/2005 | Kinross et al. | |

FOREIGN PATENT DOCUMENTS

| | | |
|---|---|---|
| JP | 01295989 | * 11/1989 |
| JP | 02300492 | * 12/1990 |

* cited by examiner

DOOR ASSEMBLY FOR AN APPLIANCE

RELATED APPLICATIONS

This application is a continuation-in-part of U.S. Ser. No. 11/412,248 filed 27 Apr. 2006 the entire disclosure of which is incorporated herein by reference for all purposes.

BACKGROUND OF THE INVENTION

This invention relates generally to an appliance, and more particularly, to a vertical lift door assembly for an appliance.

A known appliance typically includes a door for closing access to a cavity. The known appliance door is hinged along one of the edges and swings to an open position. The door therefore requires enough clear space at the front to allow for the door to open and for an operator to easily utilize the appliance. Objects in front of the appliance often interfere with the opening of the door for full access to the appliance or with an operator's positioning around the opening.

BRIEF DESCRIPTION OF THE INVENTION

As described herein, the embodiments of the invention overcome one or more of the above or other disadvantages known in the art.

In an embodiment of the invention, an appliance includes a chassis having a top, a bottom, a left and right side opposite one another other and connecting the top and the bottom, and a back opposite an opening. The chassis defines a cavity with an opening for accessing the cavity. A door assembly joined to the chassis includes a door for closing access to the opening and a first and second door lift sub-assemblies. The door lift sub-assemblies are configured to move with the door in a first direction and a second direction different than the first direction. At least one stabilizing device operatively connects the first and second door lift sub-assemblies to synchronize movement of the first and second door lift sub-assemblies in the first direction.

In another embodiment, a method of accessing a cavity of an appliance includes extending a door from a first closed position to a second extended position by moving the door along a first and second horizontal slide, the first and second horizontal slide synchronized to move in unison, and lifting the door from the second extended position to a third open position by moving the door along a first and second vertical slide.

BRIEF DESCRIPTION OF THE DRAWINGS

The following figures illustrate examples of embodiments of the invention. The figures are described in detail below.

DETAILED DESCRIPTION OF THE INVENTION

Embodiments of the invention are described below, with reference to the figures. Throughout the figures, like reference numbers indicate the same or similar components. References to preferred embodiments are for illustration and understanding, and should not be taken as limiting.

Figure 1:
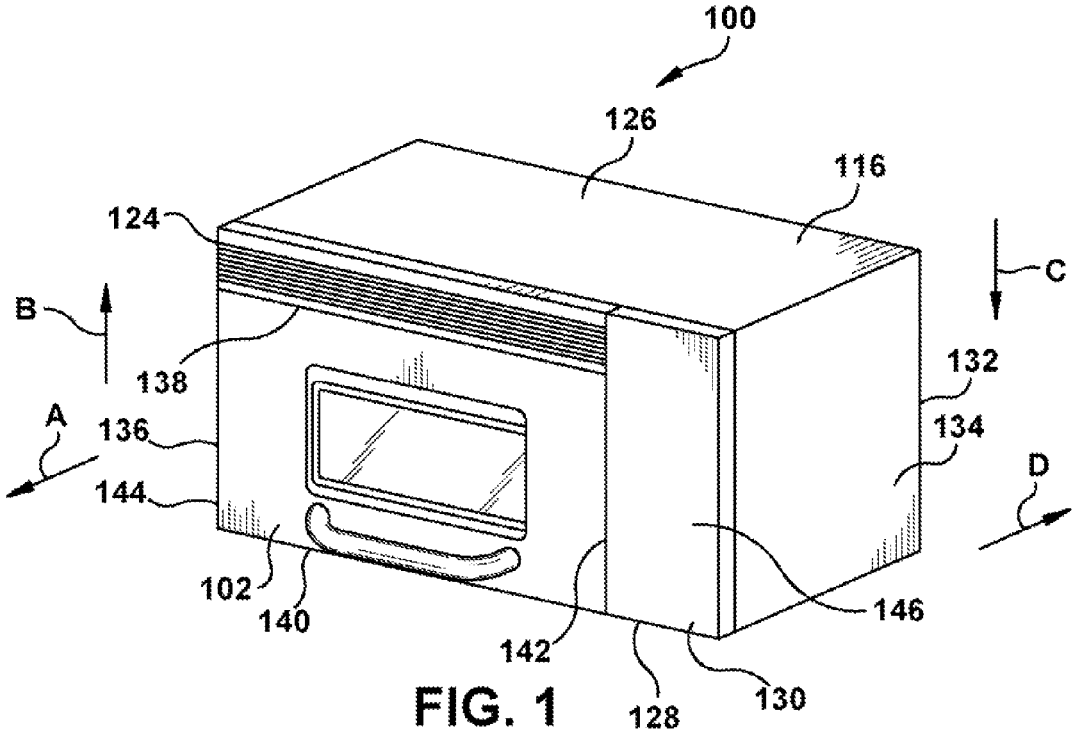
FIG. 1 is a frontal perspective view of an exemplary appliance with a door in a first closed position.
Figure 2:
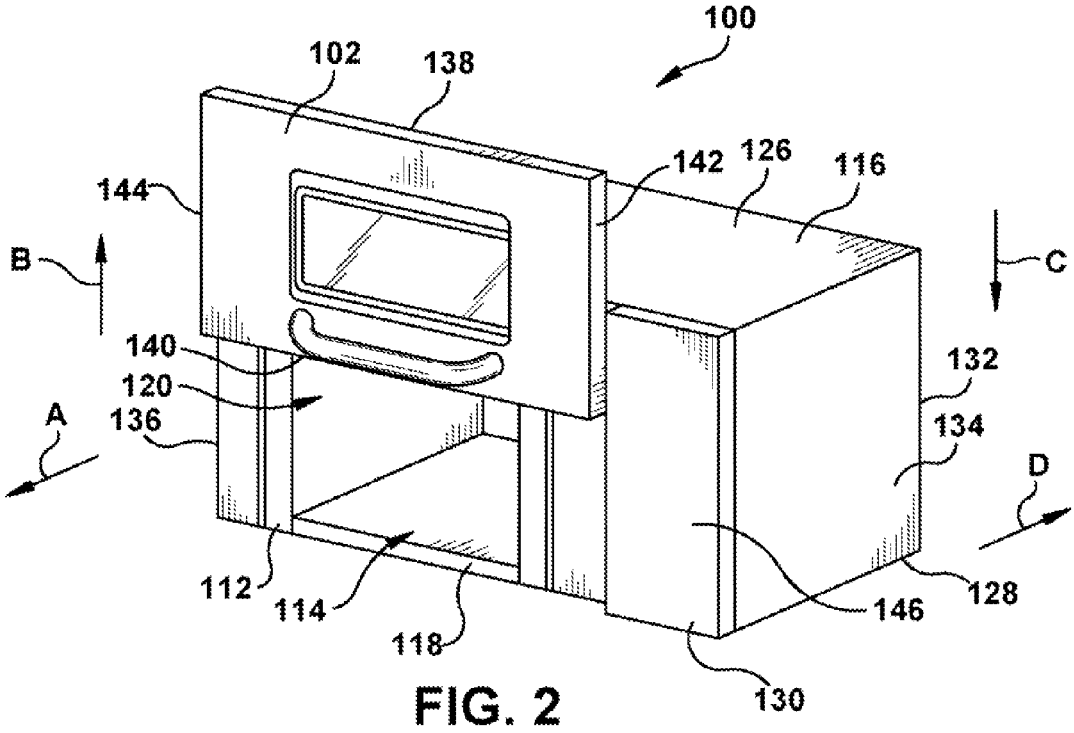
FIG. 2 is a frontal perspective view of the appliance shown in FIG. 1 with the door in a third open position.

FIG. 1 illustrates an exemplary appliance 100 with a door 102 in a closed position. FIG. 2 illustrates appliance 100 with door 102 in an open position. In the illustrated embodiment, appliance 100 is an oven, such as an over the range microwave oven, and the various components and embodiments will be described in terms of oven 100. However, it is contemplated that the various components and embodiments are applicable not only to over the range microwave ovens that are installed above a cooking apparatus, such as a gas range (not shown), but to other forms of appliances as well, such as, but not limited to, free standing microwave ovens, ranges, front loading laundry washers and dryers, dish washers, refrigerators, freezers, and the like. Therefore, oven 100 is provided by way of illustration rather than limitation.

Turning to FIGS. 1 and 2, oven 100 includes a main body or chassis 112 defining a cavity 114 therein. Chassis 112 supports a housing 116 surrounding cavity 114. A front edge 118 of chassis 112 surrounds an opening 120 that provides access to cavity 114. Door 102 closes access to opening 120 and cavity 114. Cavity 114 is surrounded by a plurality of sidewalls (not labeled), and the sidewalls are made of heat insulation material. Each of the sidewalls includes an inner porcelain coating thereon for resisting a high temperature.

In the exemplary embodiment, oven 100 includes at least one heating module such as, for example, an RF generation system (e.g., a magnetron), an upper heater module, and/or a lower heater module for cooking and/or heating items placed in cavity 114. Upper and/or lower heater module includes radiant heating elements such as a ceramic heater or a halogen-cooking lamp. Upper and/or lower heater module may also include a sheath heater. Upper and/or lower heater module may include a conventional bake element, broil element, or a convection-heating element. A convection fan may be provided for blowing air over heating elements and into cavity 114.

The specific heating elements and RF generation system can vary from embodiment to embodiment, and the elements and system described above are exemplary only. For example, upper heater module can include any combination of heaters including combinations of halogen lamps, ceramic lamps, and/or sheath heaters. Similarly, lower heater module can include any combination of heaters including combinations of halogen lamps, ceramic lamps, and/or sheath heaters. In addition, the heaters can all be one type of heater. The specific ratings and number of lamps and/or heaters utilized in upper heater module and lower heater module can vary from embodiment to embodiment. Generally, the combination of lamps, heaters, and RF generation system is selected to provide the desired cooking characteristics for speed cooking, microwave, and convection/bake modes.

In the exemplary embodiment, oven 100 includes a top 126, a bottom 128, a front 130, a rear 132, a first left side 134 and a second right side 136. Additionally, in the exemplary embodiment, door 102 includes a door top 138, a door bottom 140, a first door side 142 and a second door side 144. Door top 138, door bottom 140, first door side 142 and second door side 144 have a similar orientation as top 126, bottom 128, first left side 134 and second right side 136, respectively. Opening 120 faces front 130 and door 102 is positioned along front 130. A vent 124 is positioned along front 130 proximate top 126. A control panel 146 is positioned along first left side 134. Control panel 146 and vent 124 are substantially flush, and in plane with, door 102 when door 102 is in the closed position. In the exemplary embodiment, door 102 is slidably coupled to oven 100 such that door 102 moves along front 130 generally vertically upward from the closed position illustrated in FIG. 1 to the open position illustrated in FIG. 2. Alternatively, door 102 moves generally vertically downward.

During operation, when door 102 is in the first closed position, door 102 is moved horizontally outward, such as in the direction of arrow A, for a selected distance. The distance is selected such that door 102 will clear any obstructions vertically above door 102, such as, for example, vent 124 or cabinets. Once extended horizontally, door 102 is lifted vertically upward, such as in the direction of arrow B, to the third open position illustrated in FIG. 2. When opened, a user may access cavity 114. To close door 102, door 102 is pulled vertically downward, such as in the direction of arrow C to a lowermost position, and then door is pushed horizontally inward toward cavity 114, such as in the direction of arrow D to the closed position illustrated in FIG. 1.

Figure 3:
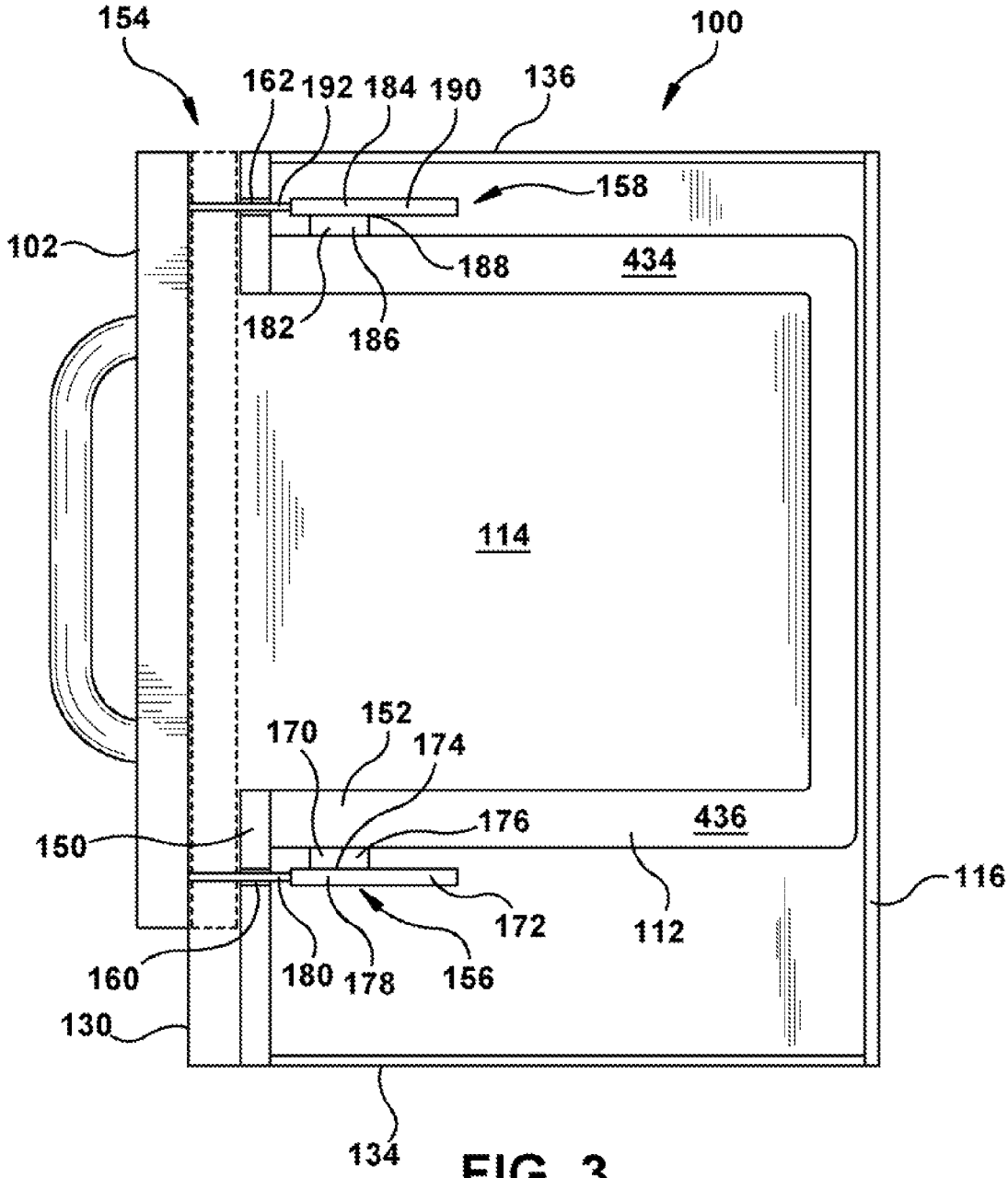
FIG. 3 is a top cross-sectional view of the appliance shown in FIGS. 1 and 2, with the door in a second extended position.

FIG. 3 illustrates a cross-sectional view of oven 100 showing door 102 in a second extended position. In the second extended position, door 102 has been moved horizontally away from cavity 114 (shown in phantom in FIG. 3 is the door 102 in the first closed position) in order to clear a portion of oven or other obstructions as door 102 is opened vertically upward. As illustrated in FIG. 3, chassis 112 includes a front frame portion 150 extending along front 130 and a cavity portion 152 defining cavity 114. Housing 116 is coupled to, and supported by, front frame portion 150.

In the exemplary embodiment, oven 100 includes a door assembly 154 joined to chassis 112. Door assembly 154 includes a first door lift sub-assembly 156 and a second door lift sub-assembly 158. First door lift sub-assembly 156 is coupled to cavity portion 152 of chassis 112 proximate first left side 134 of oven 100. Second door lift sub-assembly 158 is coupled to cavity portion 152 of chassis 112 proximate second right side 136 of oven 100. Each of first and second door lift sub-assemblies 156 and 158 are coupled to door 102. In the exemplary embodiment, first and second door lift sub-assemblies 156 and 158 are coupled to door 102 proximate door bottom 140 (shown in FIGS. 1 and 2). A portion of first door lift sub-assembly 156 extends through, and are movable within, a first slot 160 in front frame portion 150 and a portion of second door lift sub-assembly 158 extends through, and are movable within, a second slot 162 in front frame portion 150. Slots 160 and 162 provide access to door 102 from inside housing 116 and chassis 112. As such, the hardware of first and second door lift sub-assemblies 156 and 158 may be substantially enclosed and hidden from view from outside oven 100.

In the exemplary embodiment, first door lift sub-assembly 156 includes a first vertical slide 170 and a first horizontal slide 172. First vertical slide 170 is oriented to have more of a vertical direction of movement than a horizontal direction of movement, and first vertical slide 170 is configured to move door 102 in a substantially vertical direction. First horizontal slide 172 is oriented to have more of a horizontal direction of movement than a vertical direction of movement, and first horizontal slide 172 is configured to move door 102 in a substantially horizontal direction. In one exemplary embodiment, slides 170 and 172 operate independently from one another and singly such that only one of slides 170 and 172 are operated at a time; however, the slides 170 and 172 may co-operate to provide a diagonal motion of the door. In the exemplary embodiment, door 102 is mounted to first horizontal slide 172. In an alternative embodiment, door 102 is mounted to a connecting device or bracket (not shown) that is coupled to first horizontal slide 172.

First vertical slide 170 includes a fixed member 174 and a movable or sliding member 176. First horizontal slide includes a fixed member 178 and a movable or sliding member 180. In the exemplary embodiment, first vertical slide fixed member 174 is fixedly mounted to chassis 112 proximate to door 102, and first vertical slide movable member 176 is slidably coupled to fixed member 174. Movable member 176 is movable between a lifted position, generally toward a top portion of fixed member 174, and a lower or resting position, generally toward a bottom portion of fixed member 174. First horizontal slide fixed member 178 is fixedly mounted to first vertical slide movable member 176, and first horizontal slide movable member 180 is slidably coupled to fixed member 178. Movable member 180 is movable between an extended position, generally toward a front portion of fixed member 178 such as in the direction of door 102, and a retracted position, generally toward a rear portion of fixed member 178 such as away from door 102.

In the exemplary embodiment, second door lift sub-assembly 158 includes a second vertical slide 182 and a second horizontal slide 184. Second vertical slide 182 is oriented to have more of a vertical direction of movement than a horizontal direction of movement, and second vertical slide 182 is configured to move door 102 in a substantially vertical direction. Second horizontal slide 184 is oriented to have more of a horizontal direction of movement than a vertical direction of movement, and second horizontal slide 184 is configured to move door 102 in a substantially horizontal direction. In the exemplary embodiment, slides 182 and 184 operate independently from one another and such that only one of slides 182 and 184 are operated at a time. In the exemplary embodiment, door 102 is mounted to second horizontal slide 184. In an alternative embodiment, door 102 is mounted to a connecting device (not shown) that is coupled to second horizontal slide 184.

Second vertical slide 182 includes a fixed member 186 and a movable or sliding member 188. Second horizontal slide 184 includes a fixed member 190 and a movable or sliding member 192. In the exemplary embodiment, second vertical slide fixed member 186 is fixedly mounted to chassis 112, and second vertical slide movable member 188 is slidably coupled to fixed member 186. Movable member 188 is movable between a lifted position, generally toward a top portion of fixed member 186, and a reset or resting position, generally toward a bottom portion of fixed member 186. Second horizontal slide fixed member 190 is fixedly mounted to second vertical slide movable member 188, and second horizontal slide movable member 192 is slidably coupled to fixed member 190. Movable member 192 is movable between an extended position, generally toward a front portion of fixed member 190 such as in the direction of door 102, and a retracted position, generally toward a rear portion of fixed member 190 such as away from door 102.

Figure 4:
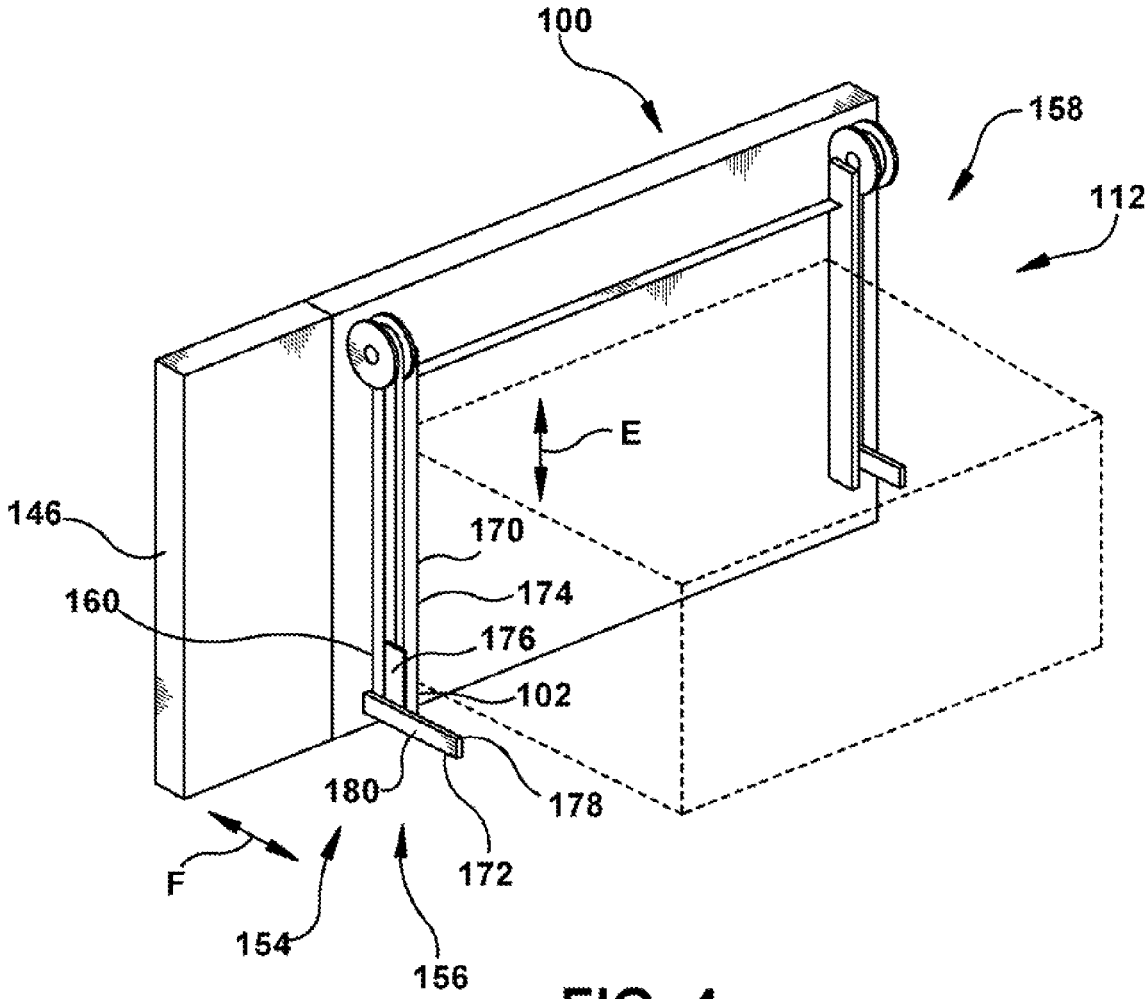
FIG. 4 is a view of a portion of the appliance shown in FIGS. 1 and 2, showing an exemplary door assembly for the appliance.

FIG. 4 illustrates a portion of oven 100 with housing 116 removed for clarity and showing door assembly 154. First door lift sub-assembly 156 is mounted to chassis 112 proximate first left side 134 of oven 100 and second door lift sub-assembly 158 is mounted to chassis 112 proximate second right side 136 of oven. The description of FIG. 4 will be described with reference to the features and operation of first door lift sub-assembly 156 with the understanding that second door lift sub-assembly 158 includes similar features and operates in a similar manner.

In the illustrated embodiment, vertical slide fixed member 174 is coupled to chassis 112. Vertical slide movable member 176 is slidable in a vertical direction along fixed member 174, such as in the direction of arrow E. Notably, movable member 176 slides upward as door 102 is opened and movable member 176 slides downward as door 102 is closed. In an alternative embodiment, door 102 opens downward; in which case, movable member 176 slides downward as door 102 is opened and upward as door 102 is closed.

Horizontal slide fixed member 178 is mounted to vertical slide movable member 176. As such, horizontal slide 172 is simultaneously movable in a vertical direction with vertical slide movable member 176. In the exemplary embodiment, horizontal slide 172 is oriented orthogonally with respect to vertical slide 170. Horizontal slide movable member 180 is slidable in a horizontal direction along fixed member 178, such as in the direction of arrow F. As indicated above, a portion of horizontal slide 172 extends through first slot 160. In the exemplary embodiment, horizontal slide movable member 180 extends through slot 160. In the illustrated embodiment, slot 160 is elongated in the vertical direction and extends parallel to vertical slide 170. As such, as door 102 is either opened or closed, horizontal slide 172 is moved vertically within slot 160.

Figure 5:
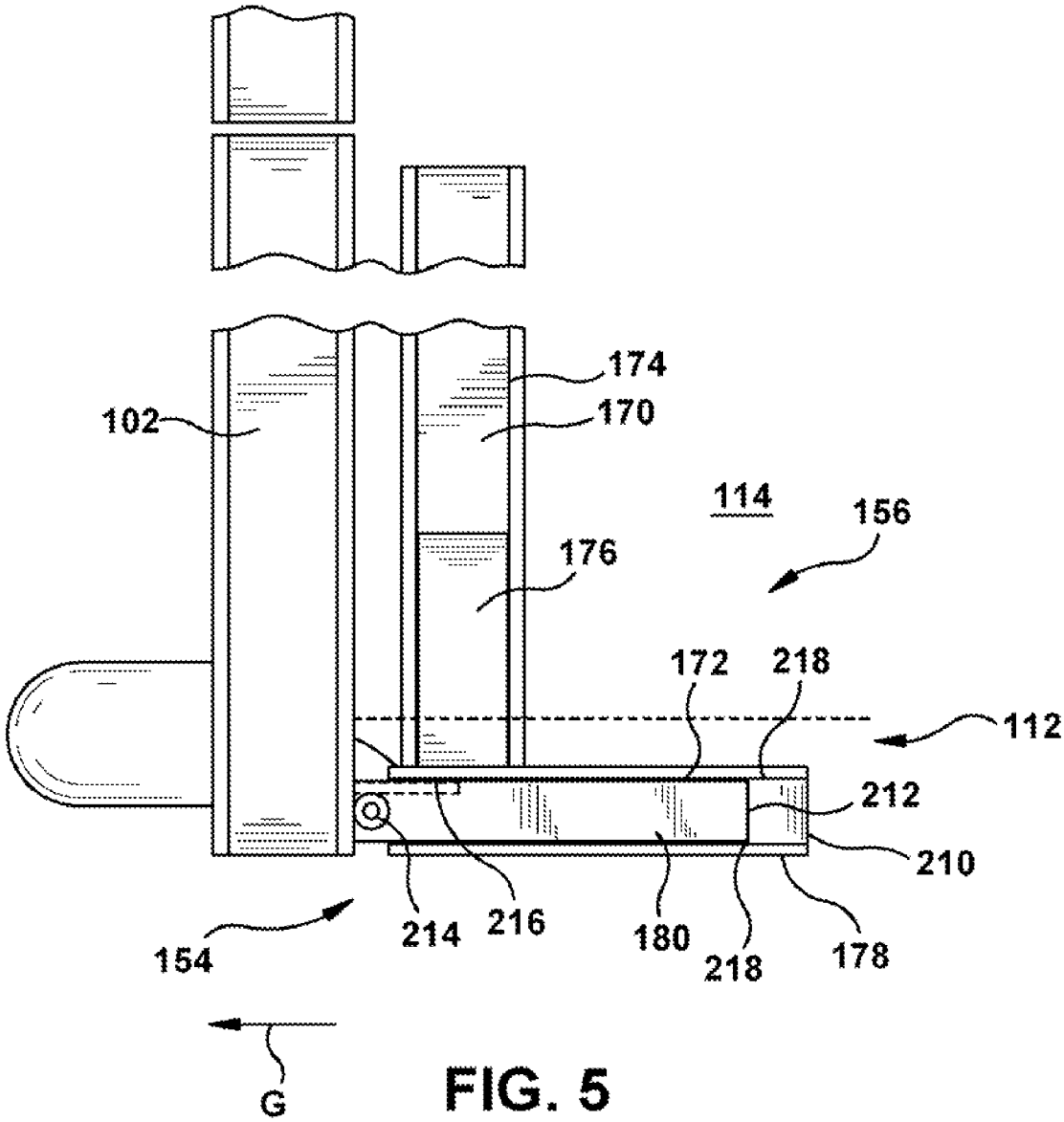
FIG. 5 is a partial view of the door assembly shown in FIG. 4 in the first closed position.
Figure 6:
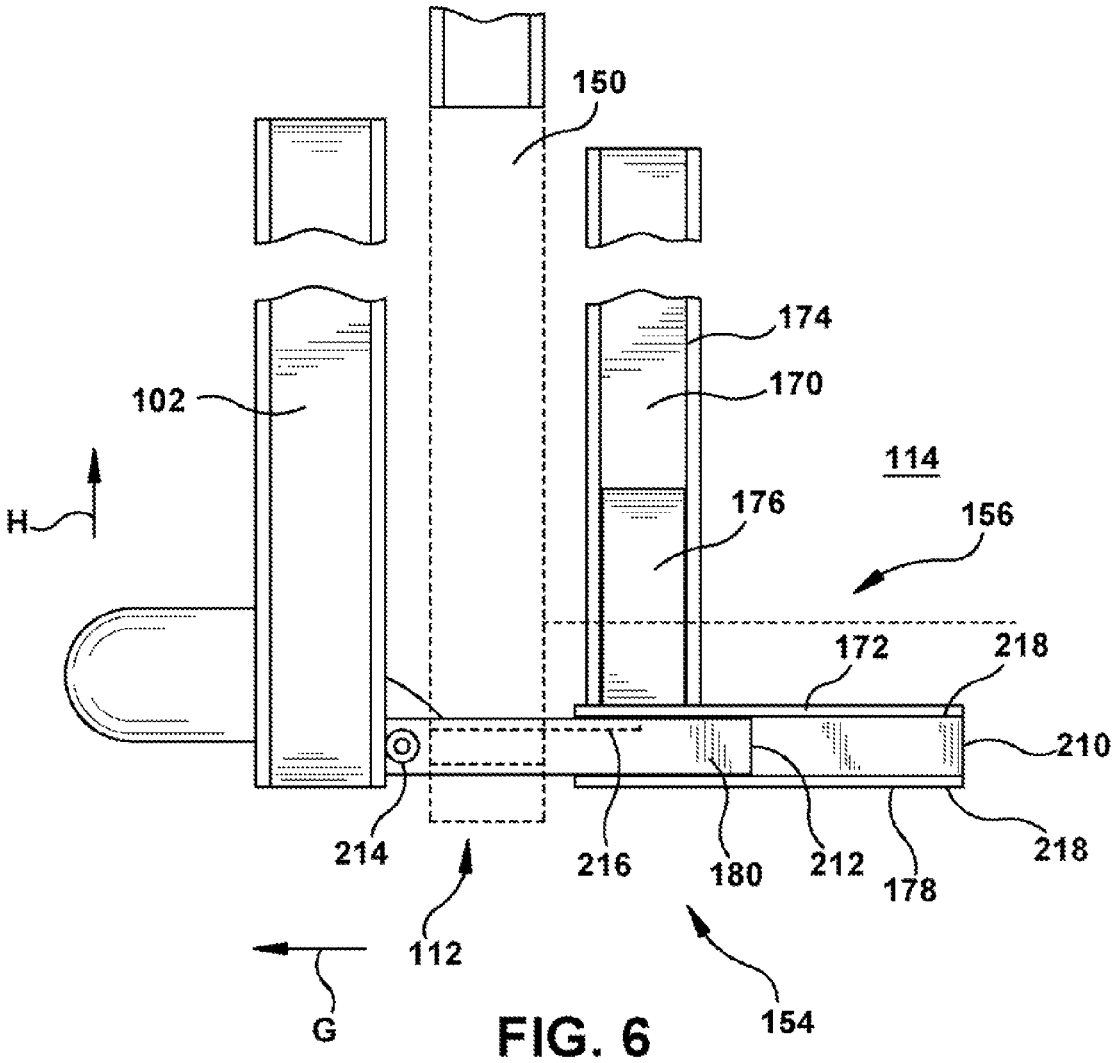
FIG. 6 is a partial view of the door assembly shown in FIG. 4 in the second extended position.
Figure 7:
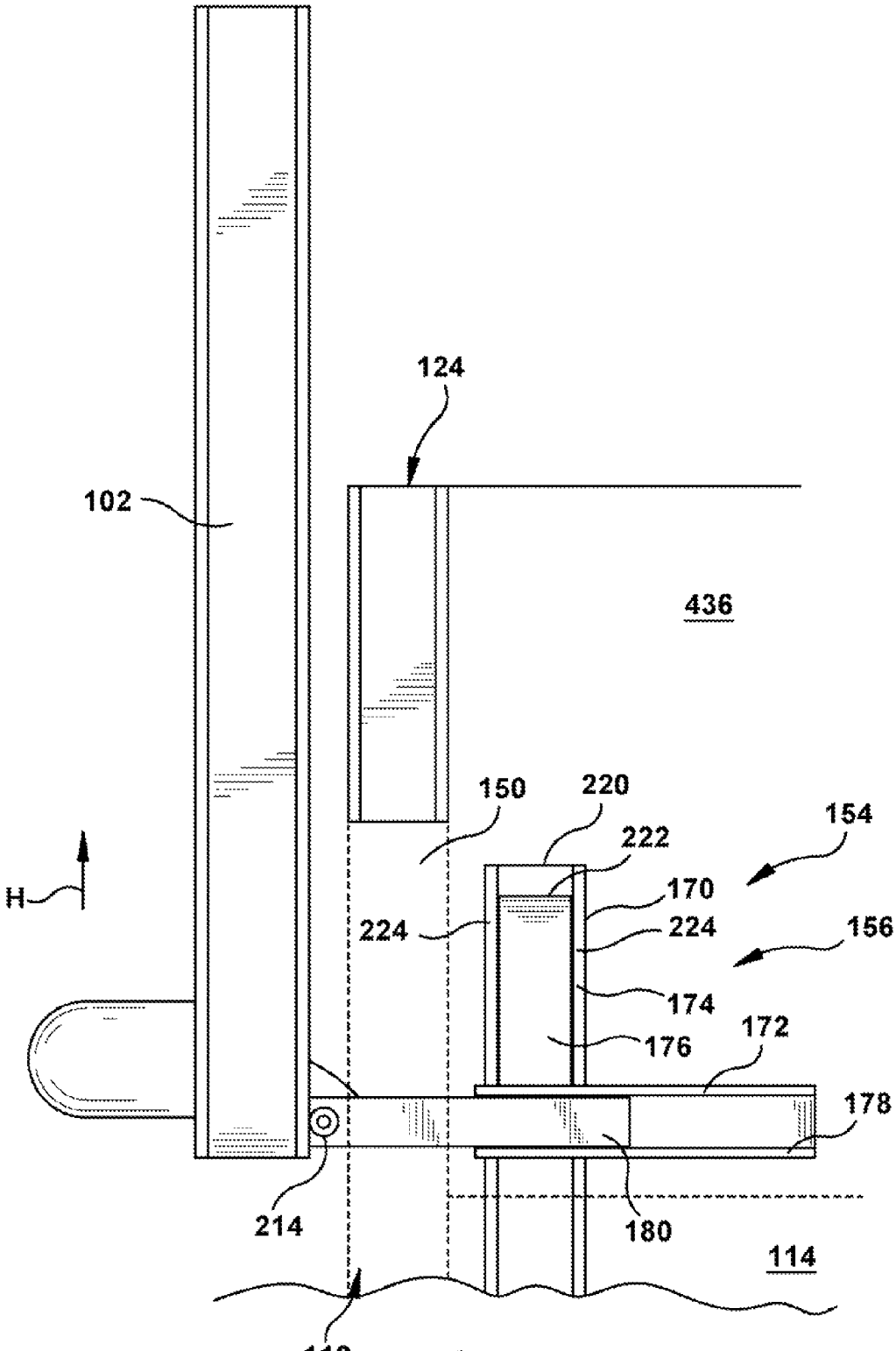
FIG. 7 is a partial view of the door assembly shown in FIG. 4 in the third open position.

An exemplary opening operation of door 102 is described below with reference to FIGS. 5-7. However, it is contemplated that other opening operations are applicable to door 102. FIG. 5 illustrates door 102 and door assembly 154 in a retracted and closed position. FIG. 6 illustrates door 102 and door assembly 154 in an extended and closed position, in that door still restricts access to cavity 114 (shown in FIG. 3) even though door is not sealed or immediately adjacent front frame portion 150 of chassis 112 (shown partially in phantom). FIG. 7 illustrates door 102 and door assembly 154 in an open position wherein cavity 114 is accessible. Thus, the opened and closed positions refer to a vertical position of door 102 with respect to front frame portion 150 and the extended and retracted positions refer to a horizontal position of door 102 with respect to front frame portion 150.

Turning to FIG. 5, in the retracted and closed position, door 102 is substantially aligned with and adjacent front frame portion 150 of chassis 112 and closes access to cavity 114. In the exemplary embodiment, oven 100 includes an interlock for locking door 102 in the retracted and closed position. The interlock is used to ensure that door 102 remains closed during operation of oven 100, and the operation of oven stops when door is no longer in the retracted position, such as when a user opens door 102. In one embodiment, the interlock may be a latch.

In the retracted position, horizontal slide movable member 180 is in a rearward position such that a rearward end 210 of moveable member 180 is positioned proximate a rearward end 212 of horizontal fixed member 178. In the one embodiment, a roller element 214 is coupled to movable member 180. Roller element 214 rotates to ease movement of door 102 between the retracted position and the extended position. In the one embodiment, a ledge 216 (shown in phantom in FIGS. 5 and 6) extends inward from front frame portion 150. Ledge 216 is positioned adjacent slot 160. Roller element 214 engages ledge 216 and is guided by ledge 216 as door 102 is moved between the retracted and extended positions. In the retracted position, roller element 214 engages ledge 216 to resist vertical movement of door 102. In the one embodiment, ledge 216 is substantially horizontal.

During operation, door 102 is pulled generally horizontally outward from cavity 114, such as in the direction of arrow G, to the extended position, which is illustrated in FIG. 6. As door 102 is moved to the extended position, roller element 214 is guided along ledge 216. Additionally, horizontal movable member 180 is guided by rail portions 218 of horizontal fixed member 178. Rail portions 218 retain movable member 180 in channels. Alternatively, rail portions 218 are provided on movable member 180 and receive fixed member 178 in the channels created by rail portions 218.

In the extended and closed position, rearward end 210 of moveable member 180 is positioned remote with respect to rearward end 212 of horizontal fixed member 178. Additionally, an upward end 220 of vertical moveable member 176 is positioned remote with respect to an upward end 222 of vertical fixed member 174. In the exemplary embodiment, horizontal slide 172 includes a stop (not shown) to limit how far movable member 180 can move with respect to fixed member 178. As such, door 102 cannot be pulled completely out of door lift sub-assembly 156. As door 102 is moved vertically between the closed and open positions, roller engages front frame portion 150 and guides door 102 along front frame portion 150 in a substantially vertical direction.

During operation, door 102 is lifted generally vertically upward, such as in the direction of arrow H, to the open position, which is illustrated in FIG. 7. In one embodiment, as door 102 is moved to the open position, roller element 214 is guided along front fame portion 150. Additionally, rail portions 224 of vertical fixed member 174 guide vertical movable member 176. Rail portions 224 retain movable member 176 in channels. Alternatively, rail portions 224 are provided on movable member 176 and receive fixed member 174 in the channels created by rail portions 224.

In the extended and open position, upward end 220 of moveable member 176 is positioned proximate upward end 222 of vertical fixed member 174. In the exemplary embodiment, vertical slide 170 includes a stop (not shown) to limit how far movable member 176 can move with respect to fixed member 174. As such, door 102 cannot be lifted completely out of door lift sub-assembly 156. In the extended position, door 102 is lifted to a position wherein cavity 114 is accessible and access to cavity 114 is generally unobstructed.

In an alternative embodiment, door 102 is moveable in a substantially arcuate path as door 102 is opened and closed. For example, door 102 may include both a horizontal and a vertical component as door is opened from the closed position. As such, both of slides 170 and 172 are operated simultaneously. Front frame portion 150 may include an arcuately shaped ledge, similar to ledge 216, for guiding door 102 along the predetermined path of travel as door 102 is opened. In another alternative embodiment, door 102 is movable from the extended and closed position in a generally downward direction to the open position.

Figure 8:
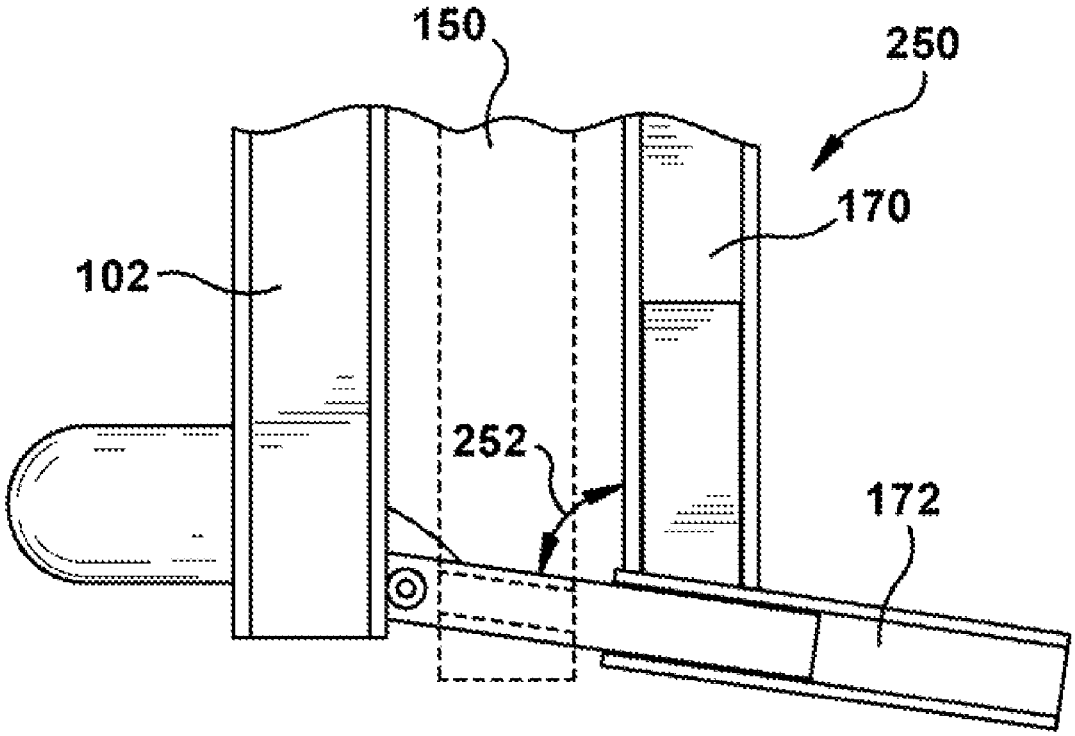
FIG. 8 is a partial view of an alternative door assembly for the appliance shown in FIGS. 1 and 2.

FIG. 8 illustrates an alternative door assembly 250. Door assembly 250 is similar to door assembly 154, and like components are identified with like reference numerals. In contrast to door assembly 154, horizontal slide 172 of door assembly 250 is oriented in a non-orthogonal orientation with respect to vertical slide 170. In the illustrated embodiment, vertical slide 170 is mounted substantially vertically within oven 100 (shown in FIG. 1) and horizontal slide 172 is inclined at a predetermined angle 252 from a perpendicular orientation of vertical slide 170. Horizontal slide 172 is partially upwardly sloped such that door 102 is lifted slightly from the retracted position to the extended position. In alternative embodiments, horizontal slide 172 is partially downwardly sloped or vertical slide 170 is angled from a vertical orientation. In one embodiment, angling of horizontal slide 172 facilitates reducing or correcting roll, pitch and/or yaw of door 102 with respect to front frame portion 150.

Figure 9:
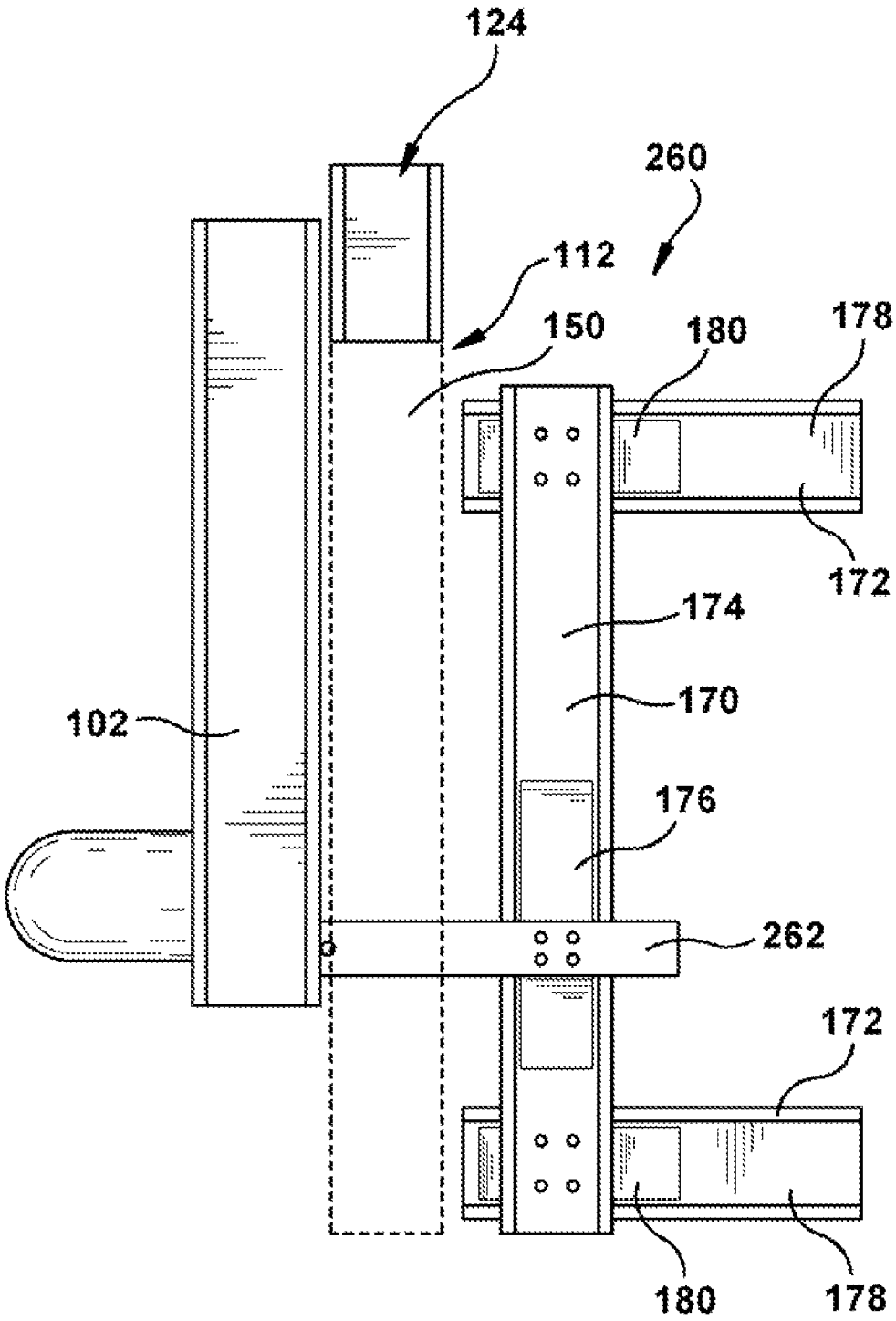
FIG. 9 is a partial view of another alternative door assembly for the appliance shown in FIGS. 1 and 2.

FIG. 9 illustrates another alternative embodiment of door assembly 260. Door assembly 260 is similar to door assembly 154, and like components are identified with like reference numerals. In contrast to door assembly 154, door assembly 260 includes multiple horizontal slides 172. Multiple horizontal slides 172 provide stability to door 102 and facilitates reducing or correcting roll, pitch and/or yaw of door 102 with respect to front frame portion 150.

Fixed members 178 of horizontal slides 172 are mounted to chassis 112. Fixed member 174 of vertical slide 170 is coupled to movable members 180 of horizontal slides 172. A connecting member 262 is coupled to movable member 176 of vertical slide 170, and door 102 is coupled to connecting member 262. During operation, door 102 is pulled outward from the retracted position. As door 102 is moved outward, vertical slide 170 is moved generally toward front frame portion 150. Once in the extended position, door 102 is moved vertically upward from the closed position to the open position. As door 102 is moved vertically, vertical slide movable member 176 is moved vertically upward along vertical slide fixed member 174.

Figure 10:
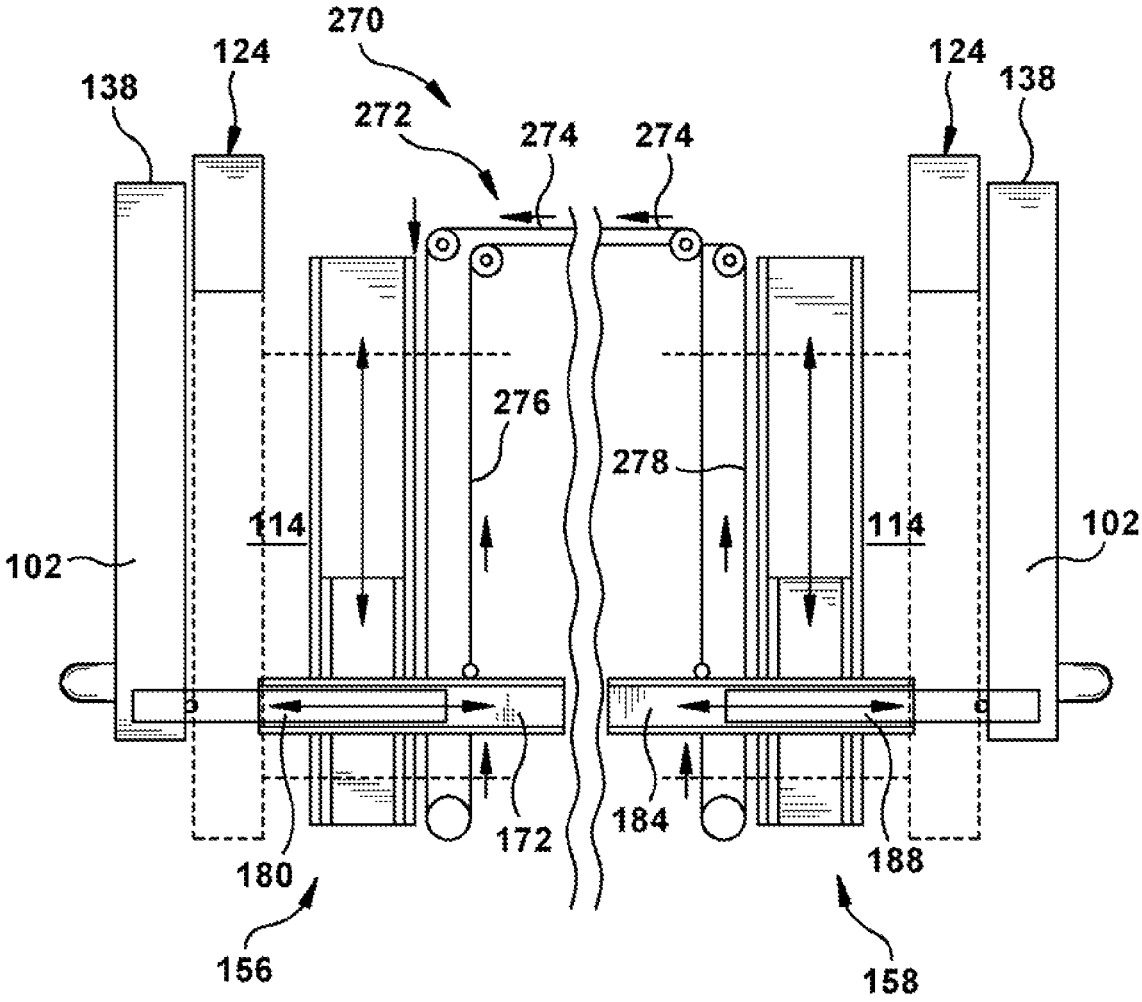
FIG. 10 is a partial view of a further alternative door assembly for the appliance shown in FIGS. 1 and 2 with an incorporated stabilizing device according to an aspect of the invention.

FIG. 10 illustrates a further alternative door assembly 270, showing side views of each of first and second door lift sub-assemblies 156 and 158 and a pulley system 272 extending there between. Door assembly 270 is similar to door assembly 154, and like components are identified with like reference numerals. In contrast to door assembly 154, door assembly 270 includes pulley system 272. Pulley system 272 includes a continuous rope or cable 274 extending between a first side 276 and a second side 278. Cable 274 is joined to first horizontal slide 172 and second horizontal slide 184 to aide in moving first horizontal slide 172 and second horizontal slide 184 along first vertical slide 170 and second vertical slide 182, respectively. Cable 274 is joined such that each of horizontal slides 172 and 184 are movable simultaneously either upward or downward, depending on if door 102 is opening or closing. Although the figures show a specific embodiment, it is to be understood that the synchronization system is not limited to the use of the cable and pulley.

In another exemplary embodiment, door 102 is rotatably coupled to horizontal slide movable members 180 and 188. As such, top 138 of door 102 may be rotated generally away from cavity 114 for cleaning door 102. In an alternative embodiment, door 102 is removably coupled to horizontal slide movable members 180 and 188. As such, door 102 may be removed for cleaning door 102.

Figure 11:
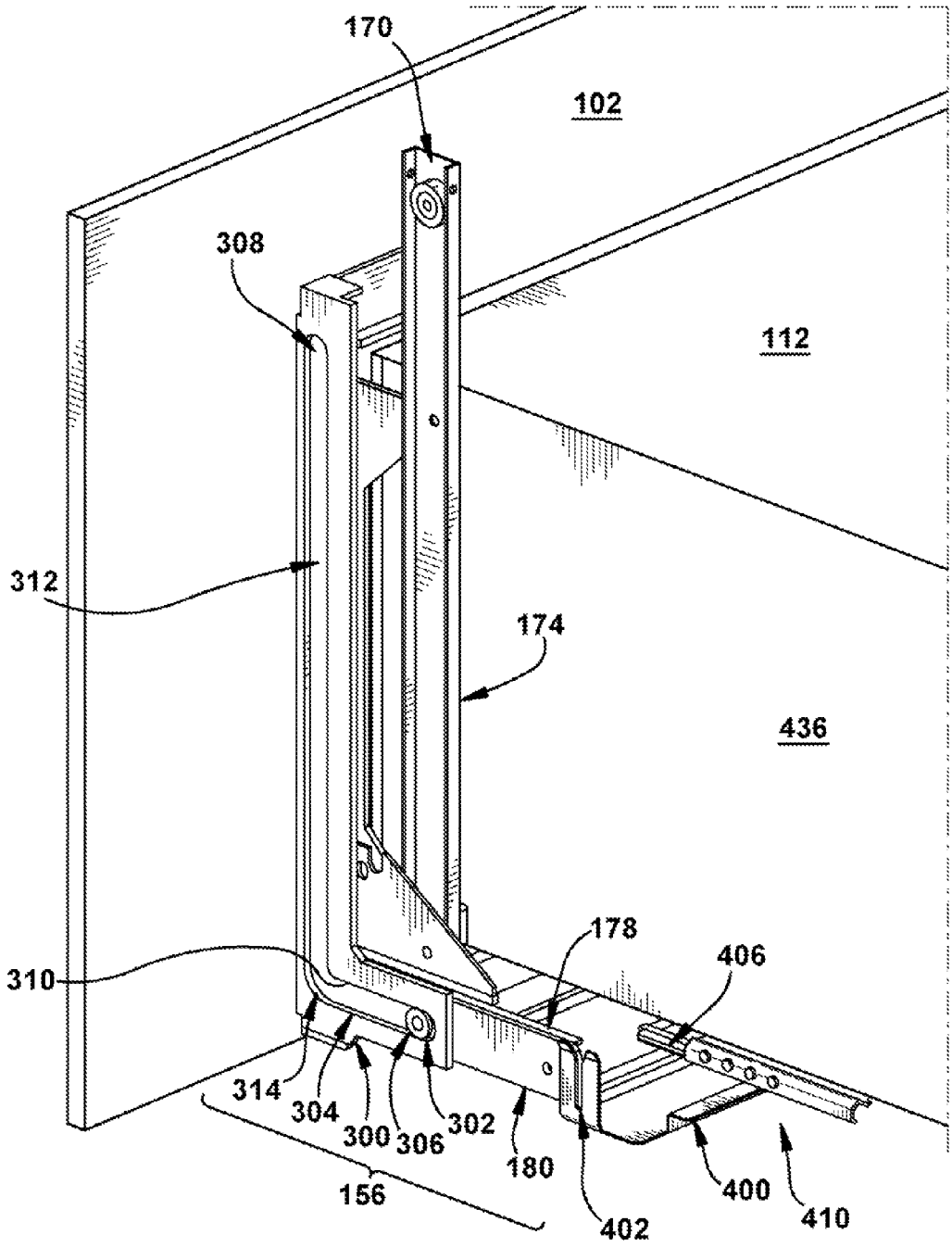
FIG. 11 is a left side perspective view of the appliance and an incorporated stabilizing device according to one aspect of the invention.
Figure 12:
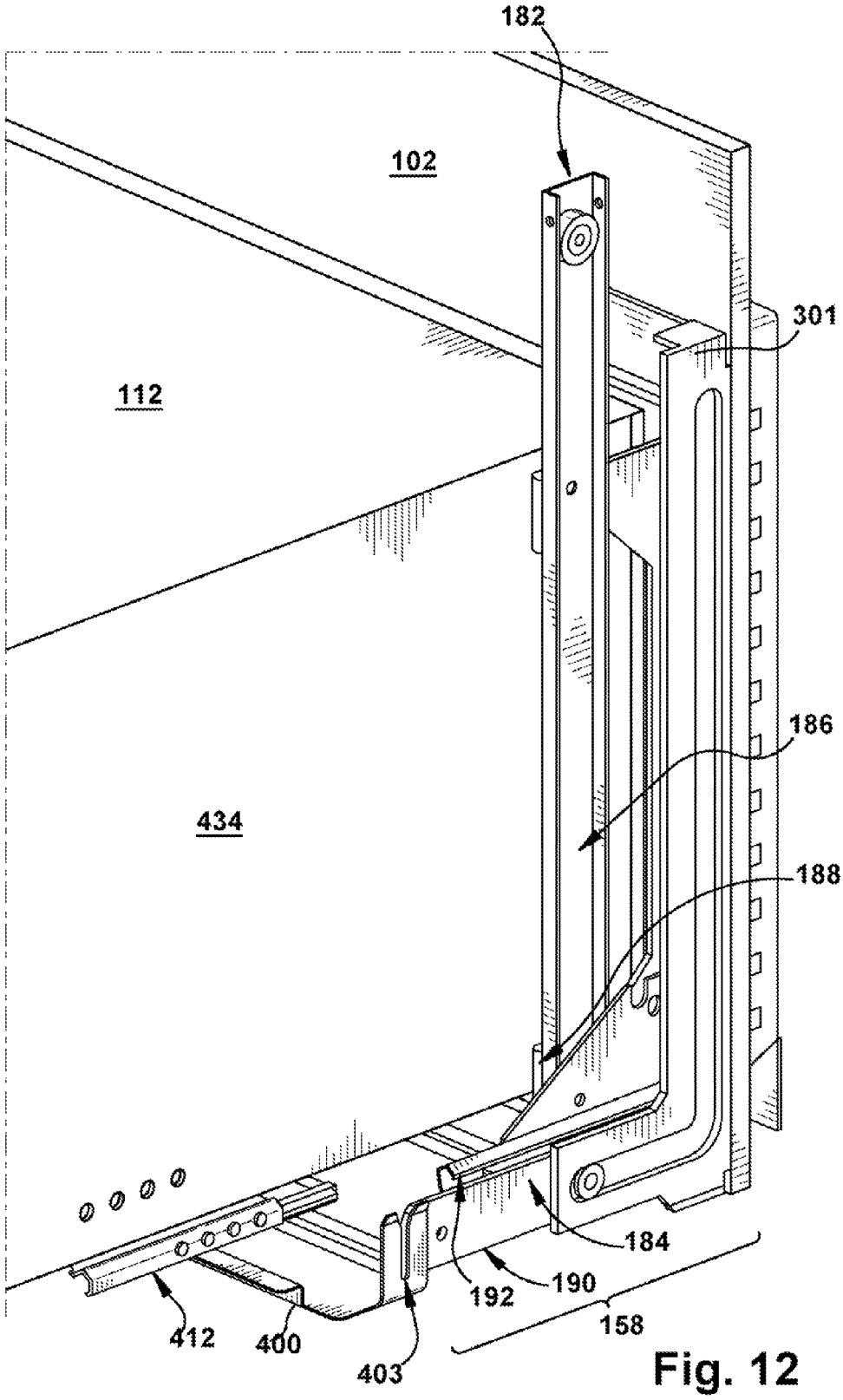
FIG. 12 is a right side perspective view of the appliance and the stabilizing device of FIG. 11.
Figure 13:
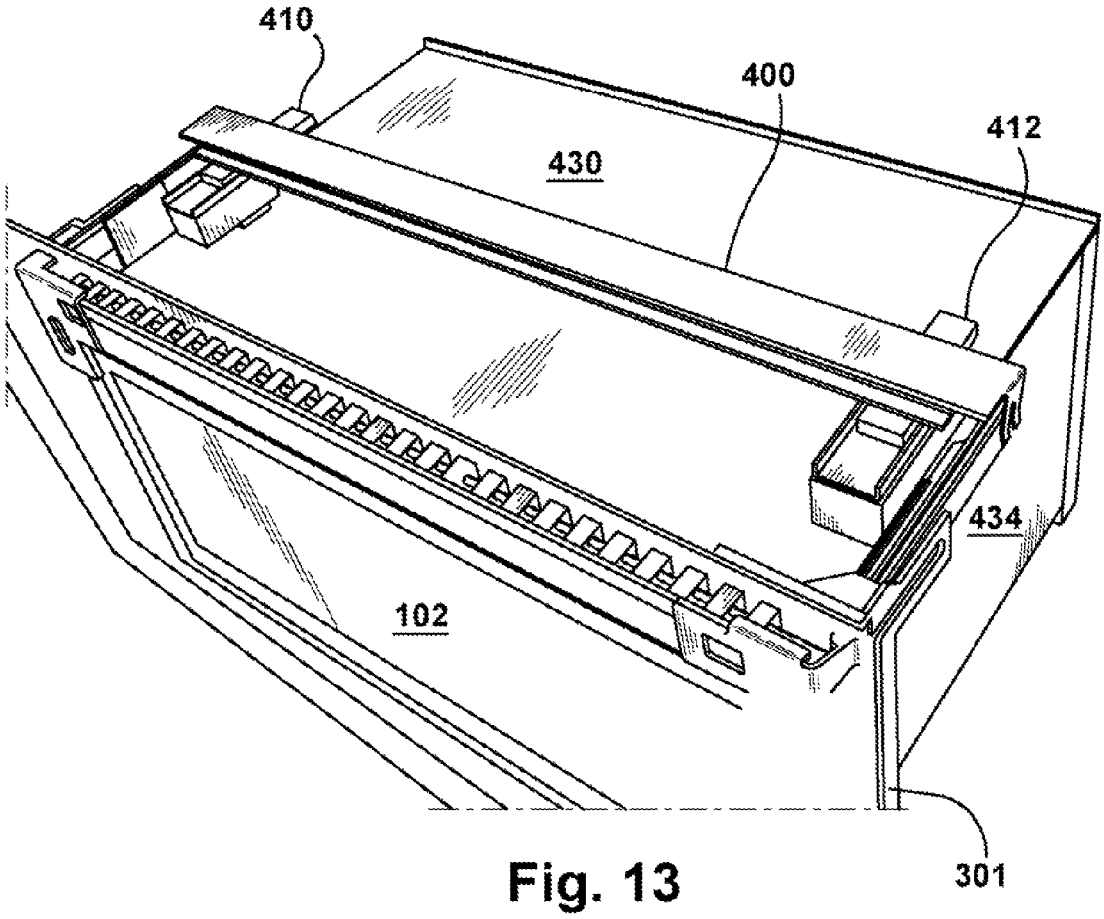
FIG. 13 is a bottom front perspective view of a stabilizing member incorporated with an appliance of FIG. 1 according to one aspect of the invention.
Figure 14:
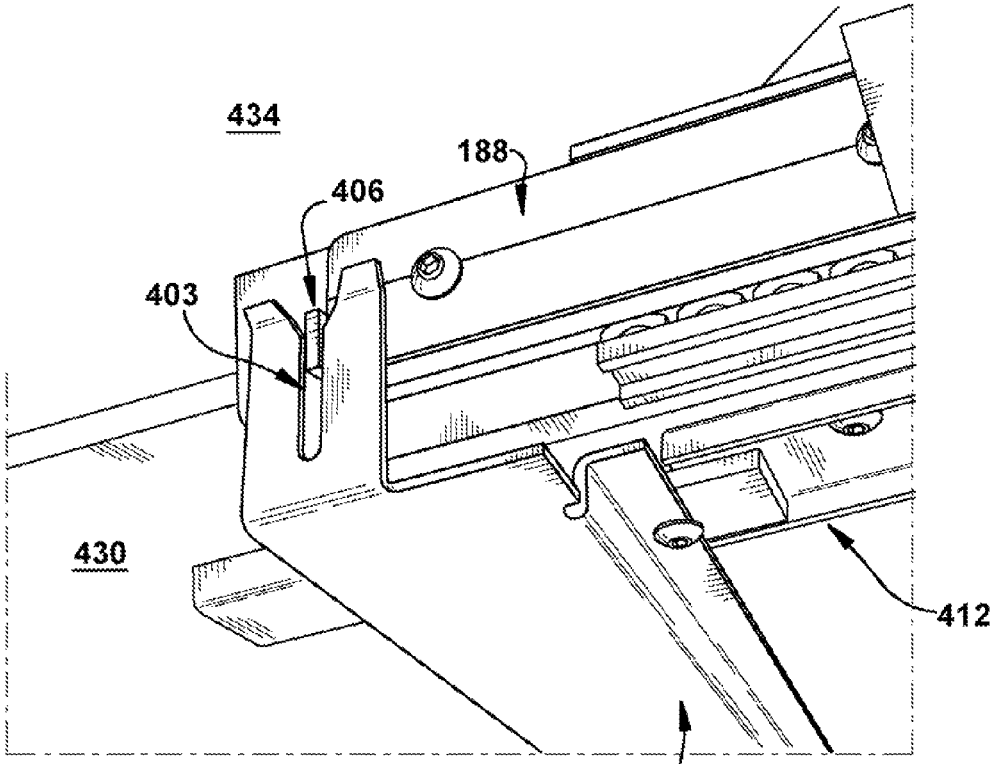
FIG. 14 is a perspective view of one end of the incorporated stabilizing member of FIG. 13.
Figure 15:
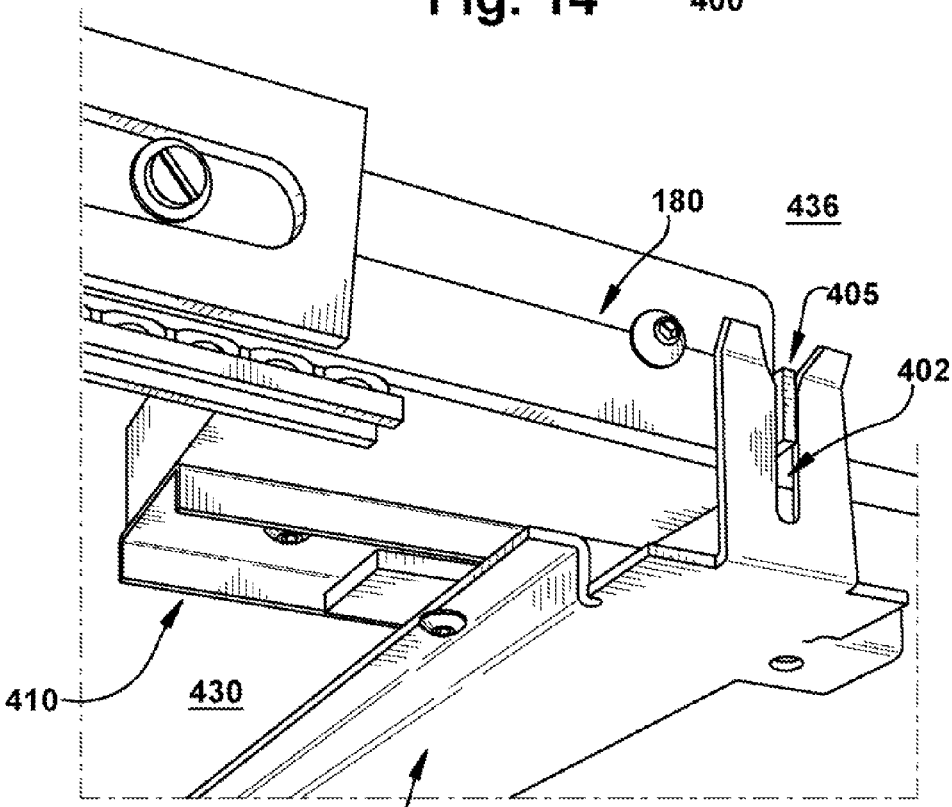
FIG. 15 is a perspective view of the other end of the incorporated stabilizing member of FIG. 13.

In another embodiment, as shown in FIGS. 11 and 12, a guide bracket 300 and roller 302 may be used to control the motion of travel of the door during opening and closing. Guide bracket 300 has a slot 304 in which roller 302 travels. Slot 304 contains a substantially horizontal portion 310 and a substantially vertical portion 312. A transition portion 314 connects the horizontal 310 and vertical 312 portions. Roller 302 is operatively connected to horizontal slide member 180. Roller 302 is in position 306 when door 102 is in a closed position. During opening of the door 102 roller 302 moves along the horizontal portion 310 (configured to constrain or limit vertical motion) of slot 304 until reaching transition portion 314 then moves up vertical portion 312 (configured to constrain or limit horizontal motion) until reaching point 308 when door 102 is fully open. The transition portion 314 of slot 304 may be abrupt so as to not allow horizontal and vertical motion of the door to occur at the same time. Transition portion 314 may not be abrupt and consist of a sloped area where horizontal and vertical motion occurs simultaneously. Alternatively the transition portion 314 may be rounded to permit smooth travel and transition from the horizontal to the vertical direction. The arc may have one uniform radius or may consist of a varying radius. Although the figures show examples of a particular embodiment, it is to be understood that different guide elements, other than the bracket and roller, can be used.

In an embodiment, guide 300 is operatively connected to side 434 of chassis 112 and a second guide 301 is connected to side 436 of chassis 112. First and second guides 300, 301 are mirror images of the other. Since each side of door 102 is synchronized to operate cooperatively and thus only one of first or second guides 300, 301 is required. Therefore, reference will be made to first guide 300, however, all features are equivalent on guide 301.

In an embodiment a stabilizing device is incorporated with and operatively connects the first 156 and second 158 door lift sub-assemblies.

As shown in FIGS. 11-15 a horizontal stabilizing member 400 is disposed under the chassis 112. The horizontal stabilizing member traverses the width of the chassis 112 and is operatively connected to the chassis 112 by at least one horizontal slide 410 and 412. In an embodiment, a third 410 and fourth 412 horizontal slides operatively connect horizontal stabilizing member 400 to the bottom 430 of chassis 112 proximate to sides 434 and 436 respectively. The horizontal stabilizing member 400 has vertical slots 402, 403 at either end for mating connection with the substantially vertical tabs 405, 406 of the sliding members 180,188 of the first and second horizontal slides of the first 156 and second 158 door lift sub-assemblies. Horizontal stabilizing member 400 is confined in movement except in a direction along an axis parallel with horizontal slides 410 and 412. This restriction of movement coordinates the movement of slides 180, 188 so neither may move independently of the other, thus preventing door 102 from rotating about a vertical axis and becoming disoriented during operation.

Figure 17:
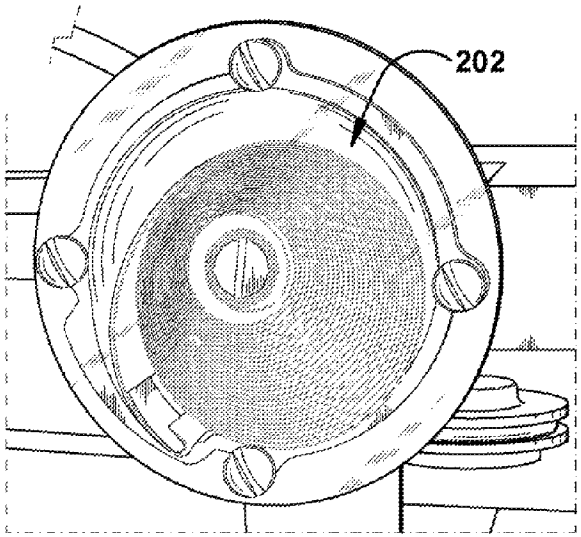
FIG. 17 is a side view of the counter balance of the invention.
Figure 18:
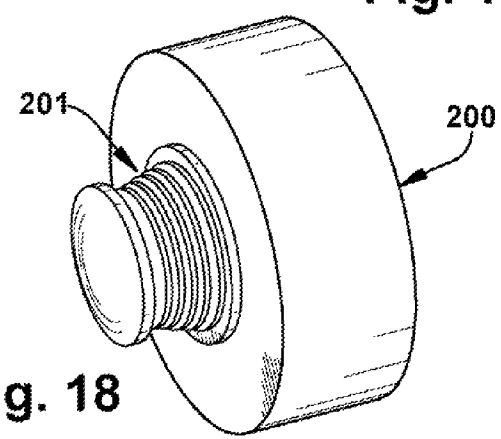
FIG. 18 is a perspective view of the varying diameter pulley of the invention.
Figure 16:
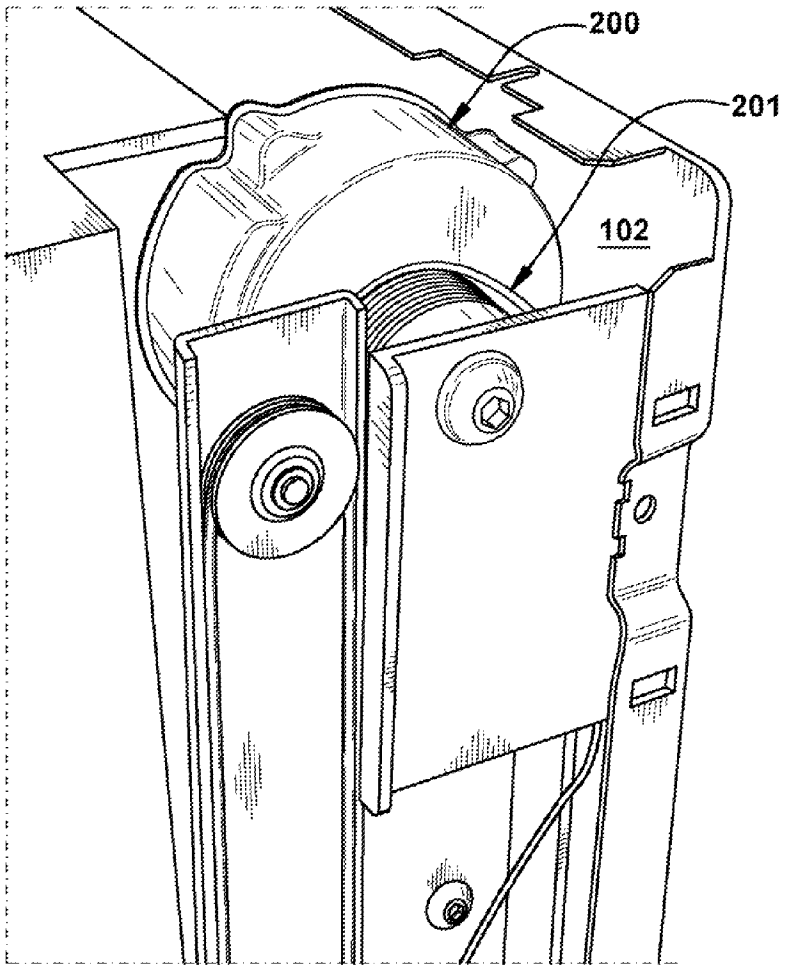
FIG. 16 is a side view of a counter balance with an incorporated varying diameter pulley according to one aspect of the invention.

As shown in the embodiment illustrated in FIGS. 16, 17 and 18, door assembly 154, 156 includes a counter-balance sub-assembly 200 to facilitate aiding a user in lifting door 102 to the open position and to provide resistance to door 102 closing prematurely or too quickly. For example, in the exemplary embodiment, counter-balance sub-assembly 200 includes a spring member 202, such as, but not limited to, a roll-up type or a spiral-type constant torsion spring, coupled to either horizontal slide 172 or vertical slide movable member 176. Spring member 202 provides a upward pulling force on horizontal slide 172 or vertical slide movable member 176 to aide in opening door 102. Spring member 202 is positioned to provide a tension on door 102 throughout the range of motion of door 102. In the exemplary embodiment, the length of spring member 202 is substantially longer than the distance of travel of door 102 to minimize the change in force over the range of motion of door 102 and provide a constant tension force on door 102. However, use of a varying diameter pulley 201 reduces the change in spring tension during the range of motion. The spring force is selected to counter the weight of the door and should be great enough to maintain the door in the third open position without the user holding the door.

In an alternate embodiment the spring is selected to raise the door with no assistance from a user. This will prevent the door closing prematurely and allow a user to remove and replace objects in the cavity without the user having to hold the door or maintain an upward force on the door.

In another alternative embodiment, a motor to lift door 102 replaces counter-balance sub-assembly 200. A switch on control panel 146 may operate the motor. In one embodiment, the motor includes a drive screw to drive the vertical slide 170 up and down. Alternatively, the motor winds or unwinds a coil or spool of material to raise or lower door 102. The motor may operate at a constant speed or may operate at a variable speed. In another alternative embodiment, counter-balance sub-assembly 200 includes a counterbalance weight that is movable to aid in the opening and closing of door 102.

A door assembly for an appliance is thus provided in a cost effective and reliable manner. The door assembly includes horizontal slides and vertical slides. An appliance door is coupled to the slides such that the door may be opened by pulling the door away from a cavity of the appliance then lifting the door to an open position. By providing a vertical lift door, the door may be opened in a different manner than a hinged door typically used with appliances. The vertical lift door needs less clearance to open the door, than other types of doors.

While the invention has been described in terms of various specific embodiments, those skilled in the art will recognize that the invention can be practiced with modification within the spirit and scope of the claims.

What is claimed is:

1. An appliance comprising:

a chassis defining a cavity and having an opening for accessing the cavity; and a door assembly joined to the chassis, said door assembly comprising:

a door for closing access to the opening;

first and second door lift sub-assemblies, each of the first and second door lift sub-assemblies comprising:

a first slide configured to move the door in a first direction between a recessed position and an extended position and comprising a first fixed member coupled to the chassis and a first movable member slidably coupled to the first fixed member, and a second slide configured to move the door in a substantially vertical direction, the second slide comprising a second fixed member coupled to the first movable member and a second movable member coupled to the door and slidably coupled to the second fixed member; and at least one stabilizing device operatively connecting the first and second door lift sub-assemblies to synchronize movement of the first and second door lift sub-assemblies in the first direction.

2. An appliance in accordance with claim 1, wherein the first direction is a substantially horizontal direction.

3. An appliance in accordance with claim 2, wherein the second movable member comprises a tab.

4. An appliance in accordance with claim 3, wherein the stabilizing device comprises a horizontal stabilizing member operatively connected to the chassis by at least one horizontal slide, the horizontal stabilizing member having a slot at either end for mating connection with the tab of the respective second movable member.

5. An appliance in accordance with claim 2, wherein the second movable member comprises a roller.

6. An appliance in accordance with claim 5, further comprising a guide operatively connected to a side of the chassis, the guide comprising a slot having a substantially horizontal portion and a substantially vertical portion joined by a transition portion, the roller operating within the slot.

7. An appliance in accordance with claim 2, further comprising a pulley and cable system operatively connecting the first and second door lift sub-assemblies to synchronize movement of the first and second door lift sub-assemblies in the second direction.

8. An appliance in accordance with claim 1, wherein the door assembly further comprises a counter balance member coupled to at least one of the first or second door lift sub-assemblies and provides a lifting force on the door.

9. An appliance in accordance with claim 1, wherein the door assembly further comprises a motor operatively coupled to at least one of the first slide and the second slide for providing a force on the first and second door lift sub-assemblies for automated opening and closing of the door.

10. An appliance in accordance with claim 1, wherein the stabilizing device comprises a horizontal stabilizing member operatively connected to the chassis by at least one horizontal slide, and connected to the second movable members of the first and second door lift sub-assemblies.

11. An appliance in accordance with claim 2, wherein the first fixed member and the first movable member are substantially horizontally disposed, and the second fixed member and the second movable member are substantially vertically disposed.

12. An appliance in accordance with claim 1, wherein the appliance is an oven or a microwave oven.

* * * * *